US005155871A

United States Patent [19]

Sams

[11] Patent Number: 5,155,871

[45] Date of Patent: Oct. 20, 1992

[54] PORTABLE CHAMBERPOTS AND DISPOSABLE CONTAINERS THEREFOR

[76] Inventor: Bernard Sams, 22 Avondale Avenue, London N12 8EJ, United Kingdom

[21] Appl. No.: 602,271

[22] PCT Filed: May 22, 1989

[86] PCT No.: PCT/GB89/00564

§ 371 Date: Nov. 9, 1990

§ 102(e) Date: Nov. 9, 1990

[87] PCT Pub. No.: WO89/11317

PCT Pub. Date: Nov. 30, 1989

[51] Int. Cl.[5] ..... A47K 11/06

[52] U.S. Cl. ..... 4/484; 108/132; 248/436

[58] Field of Search ..... 4/449, 479–484, 4/460; 108/132; 297/24; 248/151, 188.6, 436, 439

[56] References Cited

U.S. PATENT DOCUMENTS

| | | | |
|---|---|---|---|
| 1,563,236 | 11/1925 | Smith | 4/460 X |
| 1,944,335 | 1/1934 | Van Wyck | 248/439 |
| 2,615,500 | 10/1952 | Thomas | 297/54 |
| 2,804,121 | 8/1957 | Singleton | 4/483 |
| 3,061,262 | 10/1962 | Nika | 4/483 X |
| 3,235,884 | 2/1966 | Rehsteiner | 4/484 |
| 3,635,432 | 1/1972 | Hollander | 248/439 X |
| 3,936,890 | 2/1976 | Oberstein | 4/452 |
| 4,516,508 | 5/1985 | Kako et al. | 108/7 |

FOREIGN PATENT DOCUMENTS

| | | |
|---|---|---|
| 1551239 | 12/1968 | France . |
| 2382222 | 9/1978 | France . |
| 1079441 | 8/1967 | United Kingdom . |
| 1221586 | 2/1971 | United Kingdom . |
| 2184650 | 7/1987 | United Kingdom . |
| 2196246 | 4/1988 | United Kingdom . |

*Primary Examiner*—Charles E. Phillips
*Attorney, Agent, or Firm*—Diller, Ramik & Wight

[57] ABSTRACT

A portable chamber-pot comprises a seat portion (2) without a collection chamber supported on a pair of foldable side legs (14,16). A disposable liner (30) has a pair of handles (46) which can be looped around the legs (14) and has a main portion which can be draped over the seat portion (2) to define a collecting chamber. Following use the handles are knotted together and the liner (30) and contents are removed and disposed of and the legs (4, 16) can then be folded under the seat portion (2) for compact storage.

7 Claims, 4 Drawing Sheets

PORTABLE CHAMBERPOTS AND DISPOSABLE CONTAINERS THEREFOR

The present invention relates to portable chamber-pots and especially but not exclusively, to chamberpots for children or babies and to disposable containers therefor.

Chamber-pots for children (some times better known as Potty's) are generally in the form of round deep containers of plastic material having an upper rim profiled to accommodate the posterior of the user. Such pottys are portable from room to room or from house to house so that the child can perform when the urge takes him or her under adult supervision. While being portable they are nevertheless very bulky and cannot conveniently be packed away into the slim pocket of a hand bag or other carrier.

Furthermore once used they must be conveyed to the nearest sluicing facility for emptying and cleaning. There is always the danger of some spillage en route and furthermore hygenic cleaning is a somewhat bothersome and lengthy process.

It is an object of the invention to provide an improved portable chamber pot.

According to the invention there is provided a portable chamber-pot comprising a generally annular member for supporting a disposable container, the member defining a seating surface with an opening therein, and having inner and outer skirts extending generally normal to said seating surface a plurality of flanges spanning said inner and outer skirts and a pair of side walls each pivotally secured to at least, one corresponding flange and selectively positionable into first and second positions, said first position being one in which said side walls can support the member on a surface and said second position being one in which said side walls are tucked in under the member to extend across said opening for compact storage of the chamber-pot.

According to the invention there is further provided a disposable container for holding waste liquids for disposal, said container comprising a bag-like body which when in use contains absorbent material secured to the inside thereof and projections extending from the bag-like body to enable the bag-like body to be lifted, said projections being capable of being tied together to close the open mouth of the bag-like body prior to disposal.

According to the invention there is further provided a liner for a portable chamber-pot having a seat and a pair of legs, the liner comprising a flexible impervious member defining receptacle having a pair of loops for looping around the legs of said chamber-pot and a pair of flaps for draping over selected portions of the seat of the chamber-pot.

A portable chamberpot and disposable liner both embodying the invention will now be described, by way of example with reference to the accompanying diagrammatic drawings in which.

Figure 1:
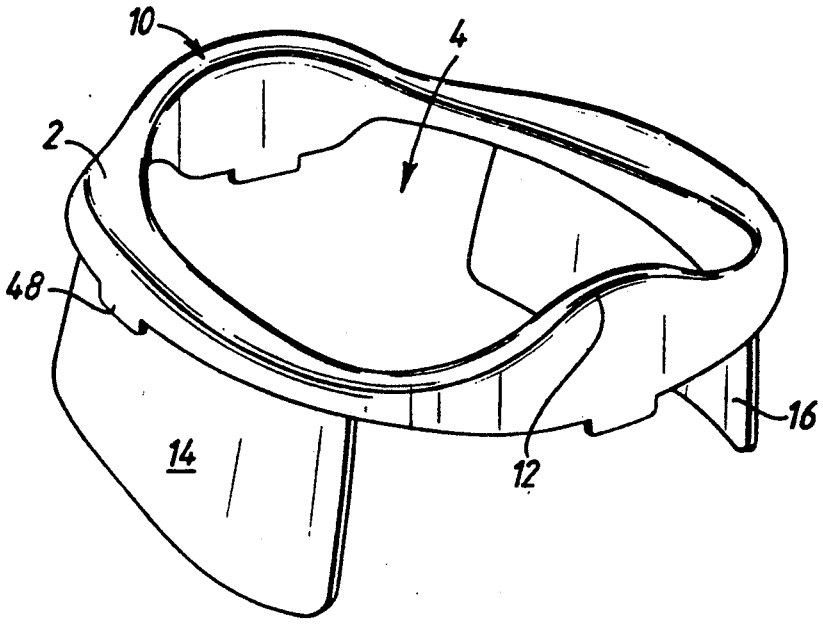
FIG. 1 is a perspective view of the chamberpot when erected but without a liner.

The chamber-pot shown in the drawings comprises a generally annular body or seat 2 having a profiled seating surface surrounding a central opening 4. The annular body 4 has inner and outer downwardly depending skirts 6 and 8; the outer skirt 8 having a greater drop than the inner skirt 6. The profiled seating surface of the annular body 2 has raised proturburances 10 and 12 at diametrically opposite ends of the chamber-pot to define the front and rear of the chamber-pot as in childrens conventional chamber-pots. The chamber-pot is supported at opposite sides by a pair of similar side walls 14 and 16. In modification the side walls may be dissimilar. The side walls 14 and 16 are coupled to the annular body 2 between the inner and outer skirts 6 and 8 and can occupy a substantially erect attitude (see FIG. 1) where the annular body is supported spaced from the floor on which the side walls 14 and 16 rest, or a folded attitude where the side walls are folded into an area bounded by the outerskirt 8 and extend across the opening 4. In the erect attitude the walls are slightly angled to the vertical for stability.

The outer skirt 8 is provided with four equiangularly spaced downwardly extending locating projections 48 for locating a liner as will be described in more detail hereinafter.

Figure 3:
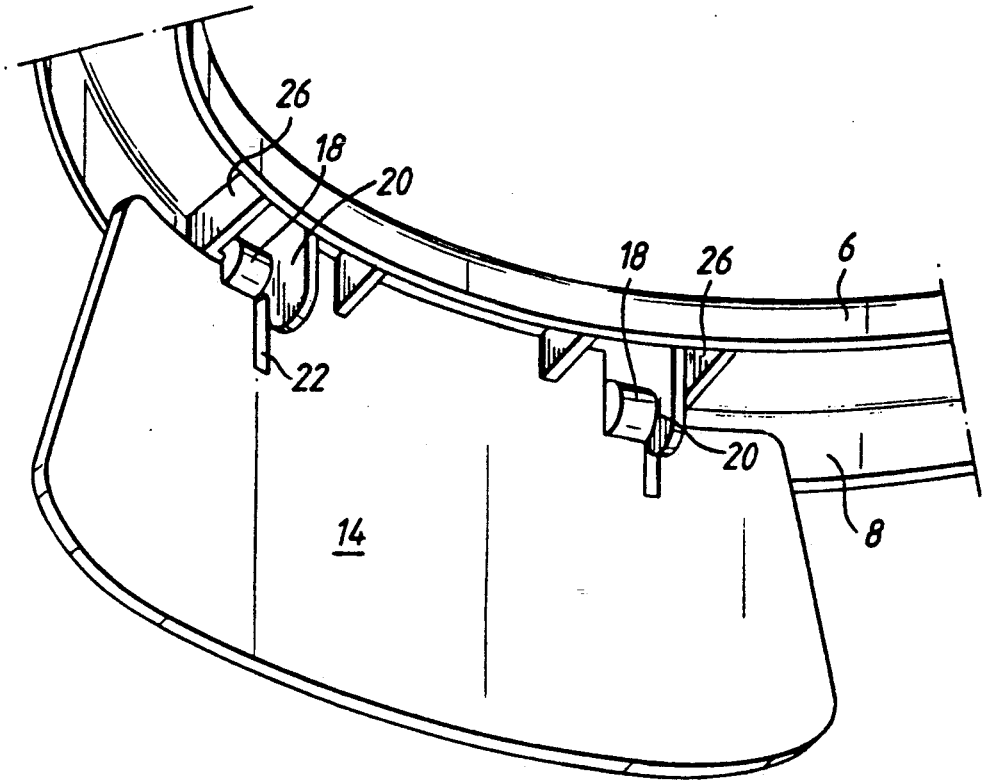
FIG. 3 is a fragmentary perspective underside view of the chamberpot of FIG. 1 illustrating the coupling between one side wall of the chamberpot and the body of the chamber pot.
Figure 4:
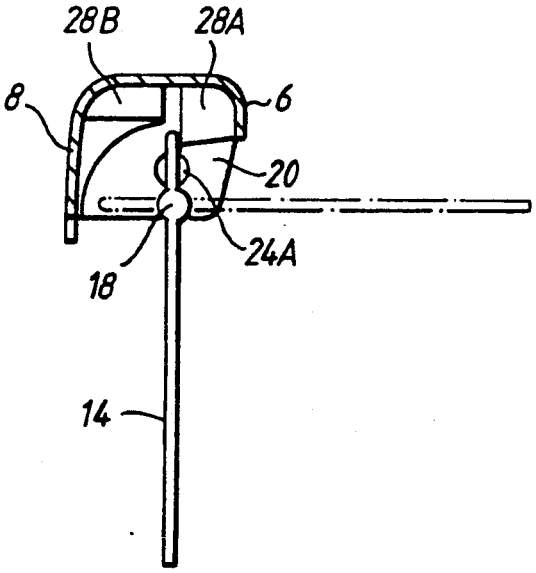
FIG. 4 is front elevation of one side wall of the chamber pot in a first position.
Figure 5:
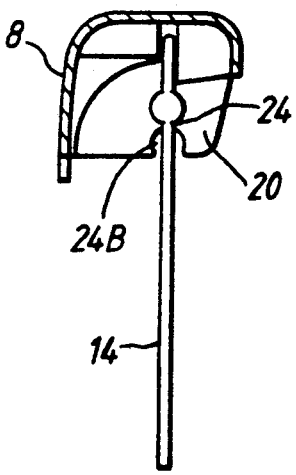
FIG. 5 is a front elevation of the side wall of FIG. 4 in a second position.

The manner in which each side wall 14 and 16 is coupled to the body 2 is more clearly shown in FIGS. 3 to 5 in which only the side wall 14 is shown; the other side wall 16 being supported in a similar manner.

The side wall 14 has a curvature which when the wall 14 is in its erect attitude conforms generally to the curvature of the inner and outer skirts 6 and 8 between which it lies. This gives the side wall 14 and 16 a degree of stability when resting on the floor.

The length of each side wall 14 and 16 is generally in excess of two thirds of the distance between the front and rear of the body 2. The side walls 14 and 16 are of reduced length at their upper ends (the end which is coupled to the body 2) so as to form a neck portion flanked by a pair of shoulders. Each shoulder carries a cylindrical pivot 18 which extends along the shoulder towards the neck portion. The pivot 18 has a diameter of greater thickness than that of the side wall. Centrally below each pivot 18 there is a slot 22 in the side wall which extends radially away from the axis of the pivot 18.

A first pair of spaced flanges 20 span the inner and outer skirts 6 and 8 on each side of the body 2. Each flange 20 is provided with a slot 24 which extends parallel to the adjacent skirts 6 and 8 and downwardly to the free end of the flange.

Each slot 24 is provided with two enlarged regions 24A and 24B sized to accommodate a corresponding cylindrical pivot 18. Thus, when the side wall is offered up to the flange 20 with the pivot 18 engaging the slot 24, it can be forced along the slot (the flange being of plastic material will deform) to cause the pivot 18 to selectively occupy one or other of the two regions 24A or 24B. When the pivot 18 occupies the lower region 24B, the side wall can pivot about the axis of the pivot 18 into a horizontal attitude (shown in broken lines in FIG. 4).

During such pivoting the lower portion of the flange 20 passes through the slot 22 so that movement of the side wall is not inhibited by the flange 20.

A second pair of flanges 26 span the inner and outer skirts on opposite sides of the pair of pivots 18. This constrains the side wall against lateral displacement along the axis of the two pivots when the pivots are pivotally supported by the two flanges 20.

Between the two flanges 20 are a further two interupted flanges 28 (each comprising parts 28A and 28B). The part 28A which extends from the inner skirt 6 has a greater drop than the part 28B which extends from the outer skirt 8. The parts 28A of the two flanges 28 define abutments for the neck portion of the side wall 14 both when the pivots are located in the upper and lower regions 24A and 24B of the slot 24. The side wall 14 is thus inhibited from pivoting outwardly from the near vertical position.

The other parts 28B of the two flanges 28 define abutments for the neck portion of the side wall only when the pivots 18 are located in the upper regions 24A of the slot 24.

Thus when the pivots 18 are in the upper regions 24A of the slot 21, the side wall is imprisoned between both parts 28A and 28B and so cannot pivot at all. When the pivot 18 is in the lower regions 24B of the slot 24, the side wall is permitted to pivot inwardly from a vertical to a horizontal position (see FIG. 4).

Figure 2:
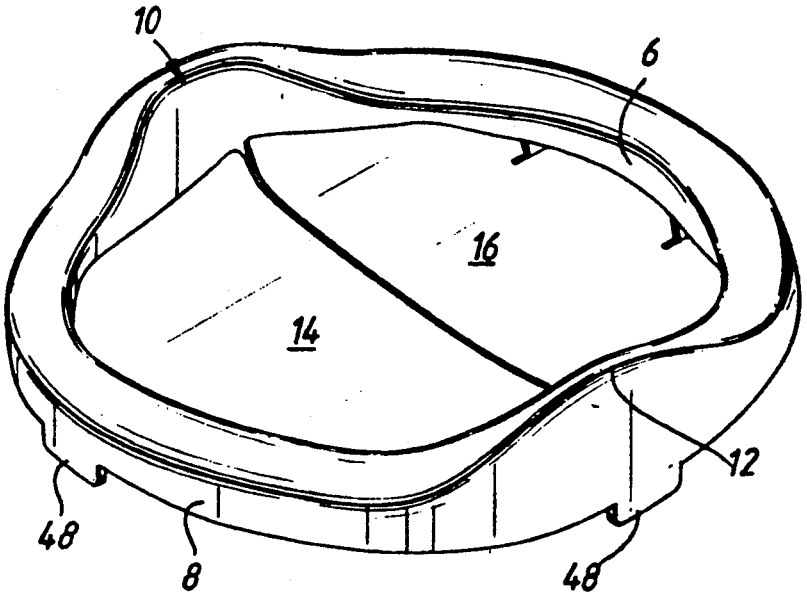
FIG. 2 is a perspective view of the chamberpot when collapsed.
Figure 6:
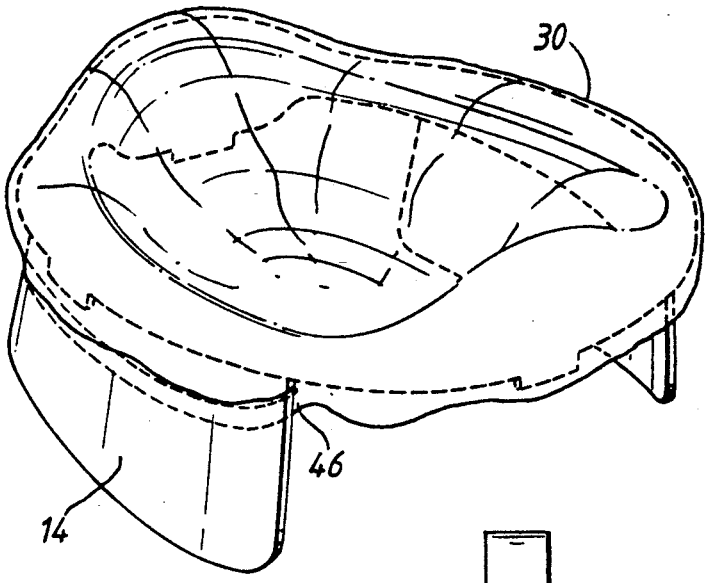
FIG. 6 is a perspective view of the chamberpot of FIG. 1 with a liner.

In operation when the chamber-pot is in its folded state (see FIG. 2) it is particularly compact and can be readily stored. To erect the chamber-pot, the side walls 14 are folded downwardly into the vertical attitude (see FIG. 4) and then pushed upwardly towards the base 2 to cause the pivots 18 to move from the lower to the upper regions of the slot 24. In this position (see FIG. 5) the neck portion is held captive between the two parts 28A and 28B of the flange 28 and so the side walls 14 will stably support the body 2 above the floor. A disposable liner 30 is now draped over the body portion (see FIG. 6) to define a receptacle into which the user of the chamber-pot may make his deposit. Once the deposit is made, the liner is removed and secured to avoid loss of the deposit. The chamber-pot may now be collapsed by following the same procedures as during erection, but in reverse. Instead of two flanges supporting each side wall at least one flange is provided for the purpose.

The liner 30 is of an impervious material preferably of plastics. The liner may be internally lined with a lining of absorbent material to soak up the liquid content of the deposit and so render disposal easier.

Figure 7:
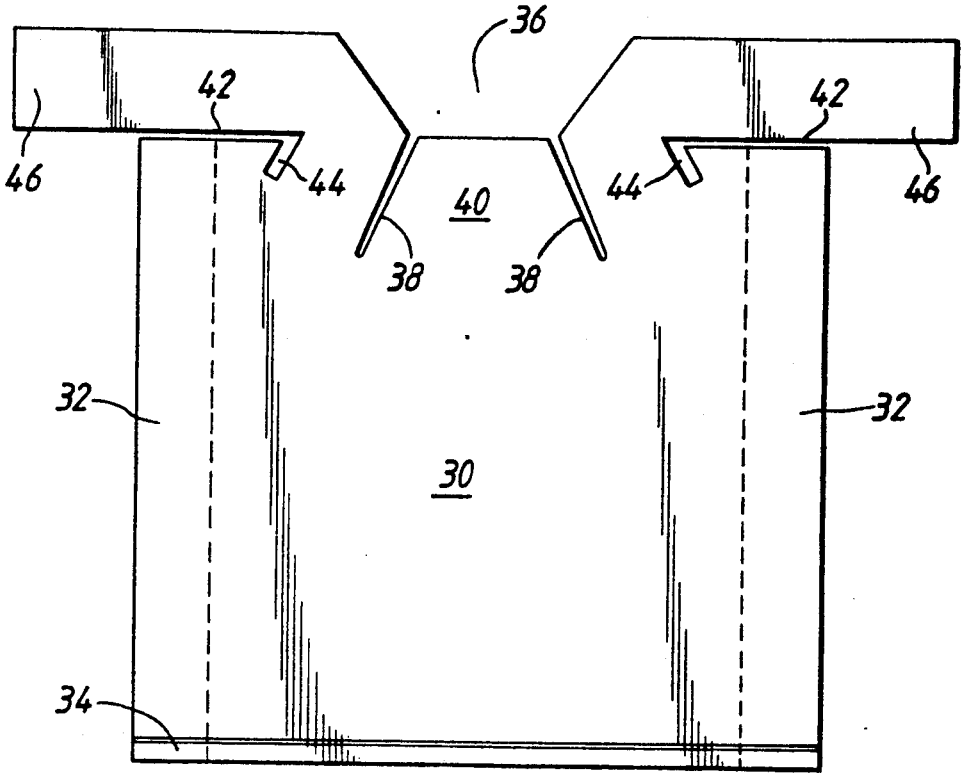
FIG. 7 is a front view of a liner for use with the chamberpot of FIG. 1.
Figure 8:
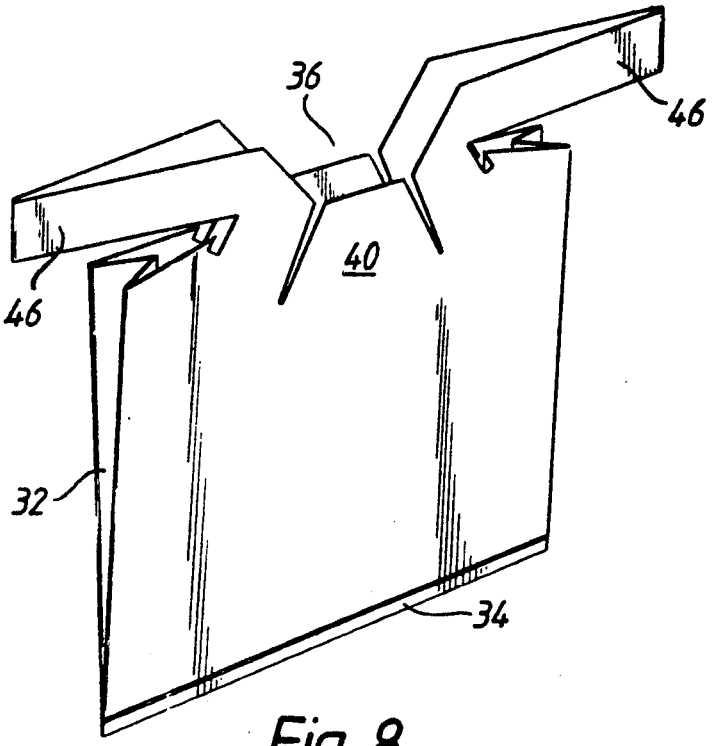
FIG. 8 is a perspective view of the liner of FIG. 6.

The liner 30 is shown more clearly in FIGS. 7 and 8. As shown (see FIG. 6) the liner has a pair of loops or handles 46 which can be used to secure the liner to the chamber-pot by looping the handles around the side walls 14.

The liner comprises a tube of plastics material which is flatened and provided with a side pleat 32 along opposite sides. The flattened tube is heat sealed at one axial end 34 and is profiled at its opposite open axial end in a particular manner. As shown an inverted fustro-conical cut out 36 is provided in the centre of the flattened open end of the liner 30. At the base of the inverted fustro-conical cut out two diverging slots 38 are cut into the liner to define fustro-conical flaps 40 which, in the installed liner, are intended to provide grips for pulling the liner fully over the seating area and in particular to drape the liner over the raised proturberances 10 and 12, for security and hygene.

Adjacent the upper end of the flattened liner and cut into the opposite sides of the liner approximately level with the base of the cut out 36 are a pair of horizontal slots 42 each terminating with a further short slot 44 which extends parallel to a respective one of the slots 38 defining the flap 40.

The slots 42, 44, the cut out 36, and the slots 38 define a pair of handles 46 with elbows which are arranged to secure the liner to the side walls of the chamber-pot and, when removed from the chamber-pot, to carry the contents deposited therein securely for subsequent disposal. Instead the handles may be knotted together to seal the contents inside the liner before disposal.

Figure 9:
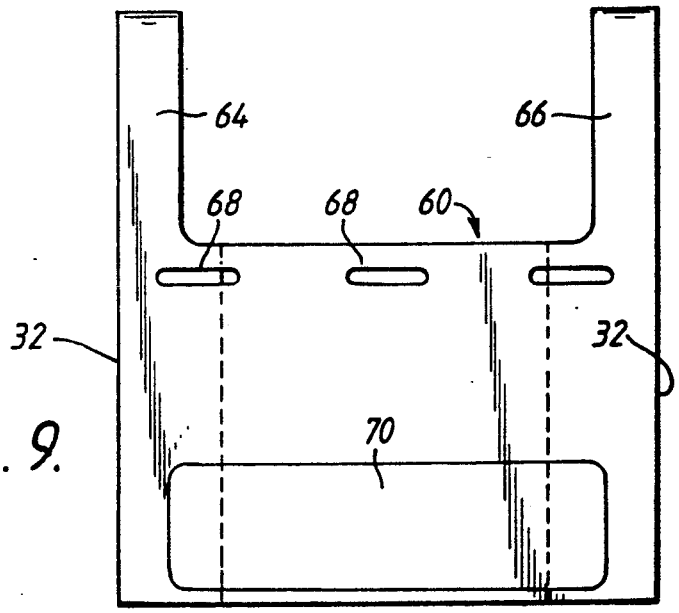
FIG. 9 is a front elevation of an alternative liner for use with the chamber-pot of FIG. 1.

The alternative liner shown in FIG. 9 is also produced from a tube of plastics material and provided with a side pleat 32 along opposite sides. The flattened tube is heat sealed at one end and is profiled at the other end to define a pair of carrying handles 64 and 66. These handles can be knotted together to close the thus formed container when filled.

Figure 10:
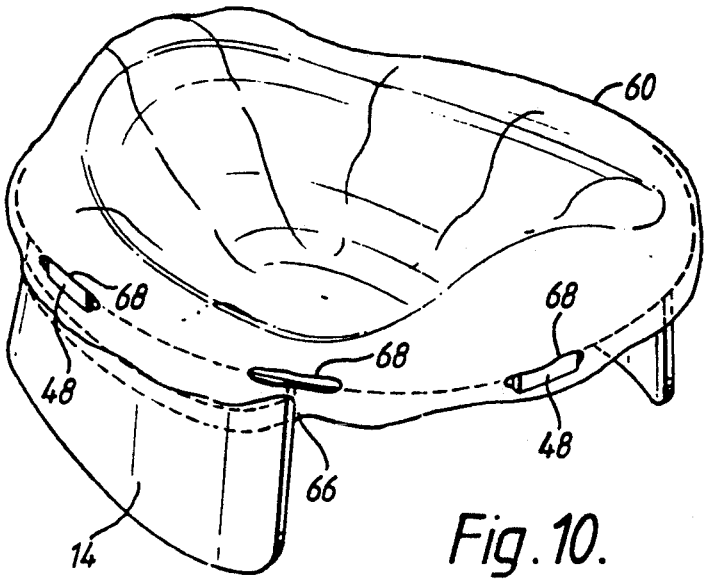
FIG. 10 is a perspective view of the chamber-pot with the liner of FIG. 9.

A series of spaced slots 68 are provided around the circumferential open end portion of the liner. These slots are arranged to engage the locating projections 48 spaced around the lower circumferential edge of the chamber-pot. The liner has six slots 68 while the chamberpot has only four projections 48 (spaced equiangularly around the chamber pot). This allows the user some flexibility in determining which slot can be coupled to which projection (see FIG. 10).

Adjacent the sealed end of the liner 60 on each side of the liner, when flattened, is a pad 70 of absorbent material. This pad 70 can be adhesively or otherwise secured to the liner.

In use the liner 7 is inverted to bring the two pads onto the inside of the liner before the liner is positioned onto the chamber-pot and then secured to the locating projections 48.

While the liner contains an absorbent lining in the form of at least one pad secured thereto it will be appreciated that the liner can also be made from a multilayer material in which the inner layer in use is a liquid absorbent material.

It will also be appreciated that the liner can be used for a variety of hygienic applications other than as a hygienic disposable container for childrens waste. For example the liner could be used as a sick bag in an aircraft and for absorbing liquid in other situations prior to disposal.

The liner and/or the absorbent material is advantageously impregnated with a disinfectant or scented material.

I claim:

1. A portable chamber-pot comprising a generally annular member for supporting a disposable container, the member defining a seating surface with an opening therein, and having inner and outer skirts extending generally normal to said seating surface, a plurality of flanges spanning said inner and outer skirts and a pair of side walls each pivotally secured to at least one corresponding flange and selectively positionable into first and second positions, said first position being one in which said side walls can support the member on a surface and said second position being one in which said side walls are tucked in under the member to extend across said opening for compact storage of the chamber-pot, each said corresponding flange has a slot having two spaced enlarged areas and wherein a said side wall has a pivot, sized to engage said enlarged areas, said pivot being movable along said slot, while effecting temporary deformation of said slot, from one said enlarged area to the other.

2. A chamber-pot according to claim 1 wherein at least one further flange acts to imprison a siad side wall against pivotal movement when said pivot engages a predetermined one of said enlarged areas.

3. A chamber-pot according to claim 1 wherein each side wall includes a slot therein to allow the passage of a portion of the or each said corresponding flange therethrough when said side wall is pivoted.

4. A chamber-pot according to claim 1 wherein a said flange acts to restrict pivotal movement of the side wall beyond the extent of the outer skirt.

5. A chamber-pot according to claim 1–2 wherein a said flange acts to constrain said side wall against movement axially of said pivot.

6. A portable chamber-pot according to claim 1 wherein said chamber-pot is of plastics material.

7. A portable chamber-pot according to claim 1 arranged to support a disposable container in the form of liner, said chamber pot including a plurality of liner locating projections arranged circumferentially of the annular member.

* * * * *